US009143850B2

(12) United States Patent
Andersen

(10) Patent No.: US 9,143,850 B2
(45) Date of Patent: Sep. 22, 2015

(54) MICROPHONE SLOTS FOR WIND NOISE REDUCTION

(71) Applicant: GN Netcom A/S, Ballerup (DK)

(72) Inventor: Michael Hoby Andersen, Copenhagen (DK)

(73) Assignee: GN Netcom A/S (DK)

( * ) Notice: Subject to any disclaimer, the term of this patent is extended or adjusted under 35 U.S.C. 154(b) by 230 days.

(21) Appl. No.: 13/692,008

(22) Filed: Dec. 3, 2012

(65) Prior Publication Data

US 2013/0142351 A1 Jun. 6, 2013

(30) Foreign Application Priority Data

Dec. 2, 2011 (EP) ..... 11191685

(51) Int. Cl.

| | |
|---|---|
| ***H04R 1/10*** | (2006.01) |
| ***H04R 1/08*** | (2006.01) |
| ***H04R 25/00*** | (2006.01) |

(52) U.S. Cl.

CPC ..... *H04R 1/10* (2013.01); *H04R 1/083* (2013.01); *H04R 25/55* (2013.01); *H04R 2410/07* (2013.01); *H04R 2420/07* (2013.01)

(58) Field of Classification Search

None

See application file for complete search history.

(56) References Cited

U.S. PATENT DOCUMENTS

| | | | | |
|---|---|---|---|---|
| 5,444,790 | A | 8/1995 | Kogen | |
| 2004/0055811 | A1* | 3/2004 | Shih | 181/129 |
| 2005/0169489 | A1 | 8/2005 | Cleckler et al. | |
| 2006/0034476 | A1* | 2/2006 | Glezerman | 381/375 |
| 2007/0286409 | A1* | 12/2007 | Liu et al. | 379/430 |
| 2008/0118096 | A1* | 5/2008 | De Pooter et al. | 381/359 |
| 2010/0166204 | A1* | 7/2010 | Yanagishita et al. | 381/71.6 |
| 2011/0129107 | A1* | 6/2011 | Andersen | 381/317 |
| 2013/0028462 | A1* | 1/2013 | Chen | 381/375 |

FOREIGN PATENT DOCUMENTS

| | | |
|---|---|---|
| EP | 2330829 | 6/2011 |
| WO | WO 2004/112424 | 12/2004 |
| WO | WO 2011/124250 | 10/2011 |

* cited by examiner

*Primary Examiner* — Thang Tran

(74) *Attorney, Agent, or Firm* — Altera Law Group, LLC

(57) ABSTRACT

A communication device (1, 15, 25, 35) comprising a housing (2) with a housing wall (50) bounding a space (7). The housing (2) comprises a first housing part (3) and a second housing part (4), which are joined along a dividing line (40), whereby a first abutment face (41) of the first housing part (3) abuts a second abutment face (42) of the second housing part (4) along the dividing line (40). A first microphone transducer (8) is arranged in the housing (2). The first microphone transducer (8) comprises a microphone opening (9), which is connected to the space (7). The space (7) is communicating with the surroundings via a peripheral line (47) of housing openings (39) in the outer side (44) of the housing wall (50) arranged along the dividing line (40), and housing channels (46) extending between the housing openings (39) and the inner side (43) of the housing wall (50). The housing channels (46) and the housing openings (39) are provided as recessions (45; 48) in the first abutment face (41). The invention also relates to the manufacturing such a communication device.

15 Claims, 6 Drawing Sheets

MICROPHONE SLOTS FOR WIND NOISE REDUCTION

TECHNICAL FIELD

The invention relates to a communication device comprising a housing, the housing comprises a housing wall with an inner side and an outer side, and wherein the housing comprises a first housing part and a second housing part, which are joined along a dividing line, whereby a first abutment face of the first housing part abuts a second abutment face of the second housing part along the dividing line, a space bounded by the inner side of the housing wall, a first microphone transducer arranged in the housing, the first microphone transducer comprises a microphone opening, which is connected to the space.

More particularly, the invention relates to a microphone arrangement in communication headsets, where the microphone is arranged in a way to reduce wind noise.

The invention also relates to a method of manufacturing a communication device.

BACKGROUND ART

The term communication device should be interpreted broad as a device used for communication and which includes a microphone transducer. Examples of communication devices are telephone handsets, handheld microphones, conferencing devices, walkie talkies, speakerphones, hearing apparatuses and headsets.

The term "headset" should be interpreted broad as a device to be mounted on or at the head of a user, and which allows hands free communication via the microphone, which captures the user's voice. In many cases, the headset also comprises an earphone to be placed at the ear of the user, so that the user can hear the voice of the other person.

There exist many different types of communications headsets. A communication headset typically comprises at least one earphone and a wearing device for attaching the earphone to the head of the user, such that sound from the earphone speaker enters the ear canal. The earphones can be secured to a user's head by different wearing devices. As examples, these can comprise a headband, a neckband, an "earring" surrounding the outer ear, an ear bud, an ear gel, an ear mould or an ear hook. Often, when ear buds, ear gels and ear moulds are used as wearing devices, the headset is simply attached to the user by inserting the wearing device into the ear of user, where it is held in place by the inner sides of the external ear or the ear canal. However, it is possible to combine ear buds, ear gels and ear moulds with other wearing devices such as ear hooks.

The headset can be corded (wired) or wireless (cordless). A corded headset is by means of a wire (cord) connected to e.g. a telephone. A wireless headset comprises a transceiver by means of which it by radio waves, typically according to the Bluetooth or DECT protocol communicates with a telephone or a headset base.

When headsets are used outdoor or in cars with open windows, the sound quality is often hampered by wind noise. Therefore, different approaches have been used to reduce the wind noise. The most used precaution is to cover the microphone behind a windscreen, which can comprise open celled foam, fabric or the like. However, as communication headsets are often compact, there is only a limited space available to accommodate traditional windscreens without destroying the overall design of the headset.

A prior art communication headset is known from US 2006/0034476 in the form of a wireless headset for use with cellular phones. A problem this headset is, that it is relatively complicated and/or expensive to manufacture in order to obtain maximum wind noise reduction.

DISCLOSURE OF INVENTION

The object of the invention is to provide a communication headset with good performance in windy environments and that can be implemented in an efficient and simple way. The object of the invention is obtained by a communication device according to the preamble wherein the space is communicating with the surroundings via a peripheral line of housing openings in the outer side of the housing wall arranged along the dividing line, the housing channels extending between the housing openings and the inner side of the housing wall, and wherein the housing channels and the housing openings are provided as recessions in the first abutment face. Such a headset is easy and cheap to manufacture and a smooth outer surface providing little turbulence can be obtained.

The diameter of the housing openings can be less than 3 mm, 2 mm, 1 mm, 0.5 mm, 0.25 mm or 0.1 mm. By using small openings, a smooth surface can be obtained. As there is a number of openings, the overall cross-sectional area for the sound to reach the microphone can kept sufficiently high.

The distance between the housing openings may be less than 3 mm, 2 mm, 1 mm, 0.5 mm, 0.25 mm or 0.1 mm. The openings are not necessary circular, but may have any shape, and the term "diameter" should therefore be interpreted as the largest dimension of the opening.

There may be at least 10, 20, 30, 40, 50, 60, 70, 80, 90 or 100 housing openings.

According to an embodiment, the housing channels are provided as narrow grooves.

According to another embodiment, the housing channels are provided by cavities between posts bordering the cavities.

According to still another embodiment, the housing channels are provided as recessions in both the first abutment face and the second abutment face.

The housing openings of the same communication device may have different shapes and/or diameters and/or have different mutually distances. Such irregularities reduce the risk of the occurrence of uniform turbulence along the line of housing openings.

The peripheral line of housing openings may extend along at least 180, preferably at least 270, more preferably at least 315 and most preferably 360 degrees of the periphery, when seen from a microphone transducer. In these cases, the risk of the wind building up pressures due to "blind holes" can be reduced efficiently.

The housing may comprise a boom, wherein the peripheral line of housing openings is provided at the end of the boom. In this case, a better sound quality can be obtained, as the microphone can be placed closer to the user's mouth during use.

The communicating device may be embodied as a communication headset, wherein the housing is adapted to be arranged at the ear of a user and comprises a speaker.

The headset housing may comprise transceiver electronics for wireless communication with a communications device, such as a cell phone. The transceiver electronics may follow the Bluetooth standard.

According to an embodiment, the first abutment face and the second abutment face are non-planar. In this case, it may be easier to assemble of the first housing part and the second housing in a correct relative position, and a more sturdy housing may be obtained as the abutting surfaces may lock each other in certain directions.

Preferably, the dividing line extends along the outermost periphery, when seen in projection. Hereby, a relatively long distance between the microphone transducer and the windy surroundings can be obtained despite the housing being small.

The invention also relates to a method of manufacturing a communication device comprising the following step:

providing a first housing part with a housing wall with an inner side, an outer side and a first abutment face, wherein housing openings along a peripheral line in the outer side of the housing wall and housing channels are provided as recessions in the first abutment face, providing a second housing part with a housing wall with an inner side, an outer side and a second abutment face, joining the first housing part and the second housing part to a housing, such that the first abutment face abuts the second abutment face along a dividing line, whereby the inner side of the housing bounds a space, and whereby the recessions provide housing channels extending between the housing openings and the inner side of the housing wall, so that the space can communicate with the surroundings, and providing a first microphone transducer in the housing, wherein the first microphone transducer comprises a microphone opening, which is connected to the space.

The recessions providing the housing openings and the housing channels in the first abutment face may be provided by moulding, f. ex. injection moulding.

According to an embodiment, the microphone opening points in a direction, which is perpendicular to the first abutment face. With such a construction, the risk of wind noise due to the fact, the microphone opening itself may create a small "blind hole", is reduced.

In a particularly preferred embodiment, the line of housing openings essentially extends parallel to the side of the head of a user, when the headset is worn by the user.

According to yet another embodiment, the communication device is embodied as a hearing aid.

BRIEF DESCRIPTION OF THE DRAWINGS

The invention is explained in detail below with reference to the drawing illustrating different embodiments of the invention and in which.

MODES FOR CARRYING OUT THE INVENTION

In the following, the same reference signs are, in several instances, used for the same or corresponding parts in the different embodiments. All figures are schematically showing the most important features only. Some features are left out in order to clarify the invention.

Figure 1:
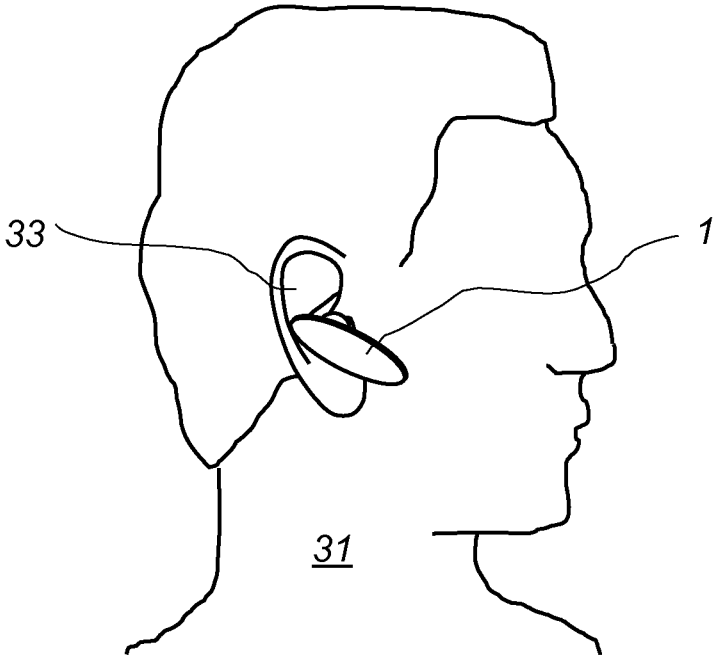
FIG. 1 is a perspective view of a user wearing a communication headset according to a first embodiment of the invention.
Figure 2:
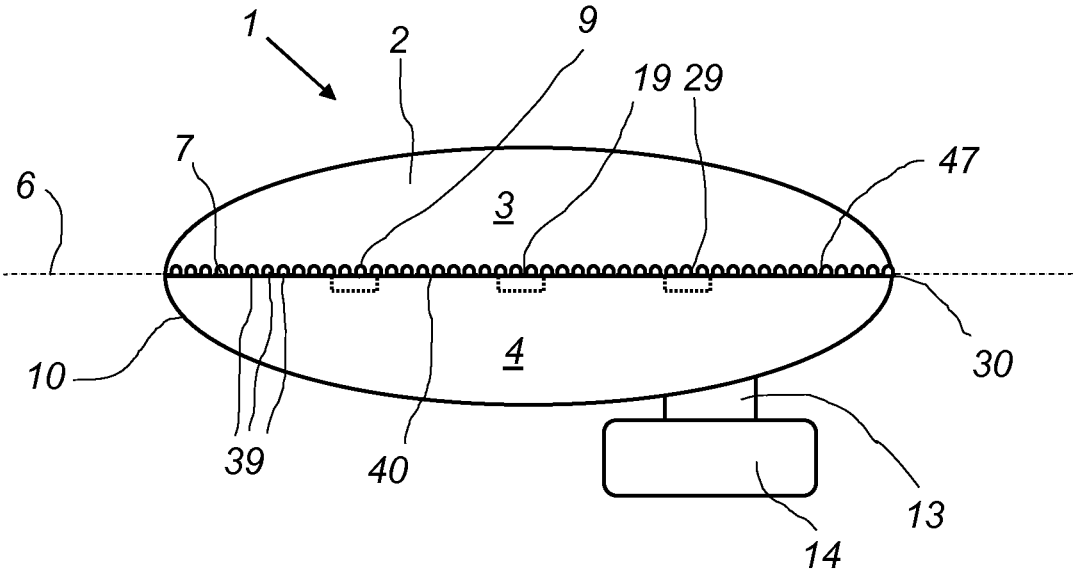
FIG. 2 is a side view of the headset according to the first embodiment of the invention.

FIG. 1 discloses a user 31 wearing a headset 1 at his right ear 33. The headset 1 is a wireless headset communicating with a peripheral device such as a mobile phone according to the Bluetooth™ standard.

Figure 3:
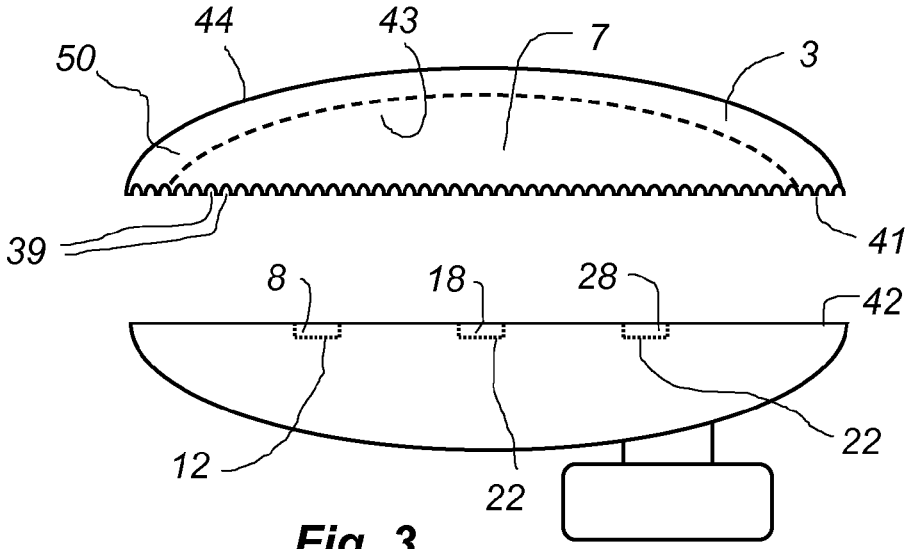
FIG. 3 is a side view of the headset according to the first embodiment of the invention, where a first housing part and a second housing part are removed from each other.
Figure 4:
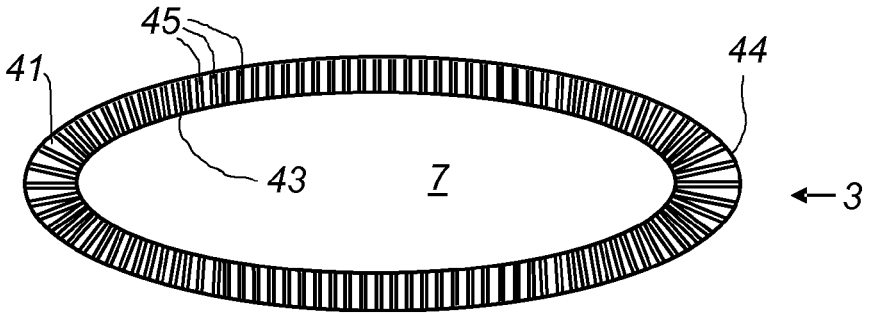
FIG. 4 is a bottom view of the first housing part of the first embodiment of the invention.
Figure 5:
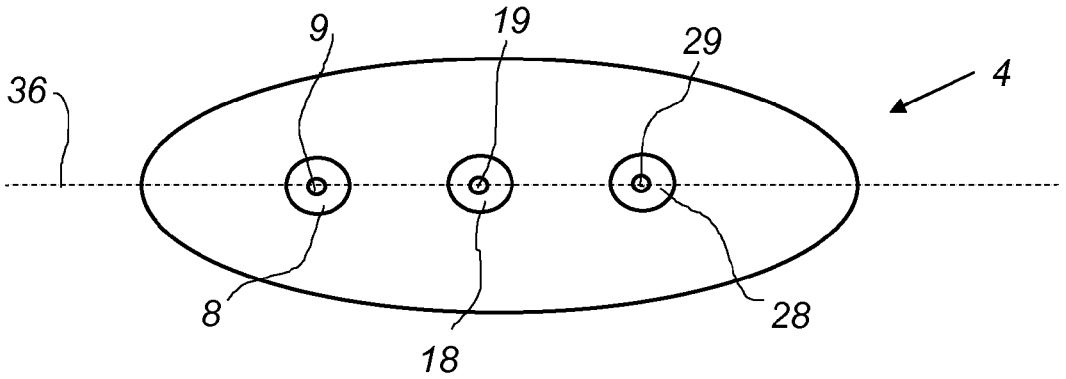
FIG. 5 is a top view of the second housing part of the first embodiment of the invention.
Figure 6:
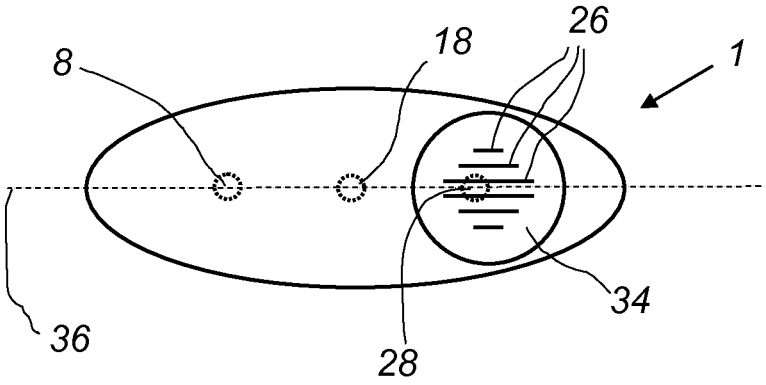
FIG. 6 is a bottom view of the headset according to the first embodiment of the invention.

FIGS. 2-6 disclose a headset 1 according to a first embodiment of the invention. FIG. 1 is a side view of the headset 1, and FIG. 6 discloses a bottom view of the same. The headset 1 comprises a housing 2, a protruding speaker tower 13 and an ear bud 14 at the free end of the speaker tower 13. The headset 1 is simply attached to the head of the user 31 by inserting the ear bud 14 into the outer ear 33, where it is held in place by the internal sides of the outer ear 33. However, other attachment means, such as an ear hook, a headband or a neckband, could be used as well. A speaker transducer (not shown) is arranged in the speaker tower 13, but could alternatively be arranged in the housing 2. Audio from the speaker transducer is conducted to the user's ear through openings 26 in the front face 34 of the ear bud 14. In a plane 6, that intersects the housing 2, a dividing line 40 divides the housing 2 into a first housing part 3 and a second housing part 4. FIG. 3 discloses the headset 1 in a side view where the first housing part 3 and the second housing part 4 are moved away from each other. FIG. 4 shows a bottom view of the first housing part 3 and FIG. 5 shows a top view of the second housing part 4. When assembled a first abutment face 41 of the first housing part 3 is abutting a second abutment face 42 of the second housing part 4. The first housing part 3 has a housing wall 50 and the inner side 43 of the housing wall 50 and the second abutment face 42 defines an internal space 7. Narrow grooves 45 provided in the first abutment face 41 extend between the space 7 and the surroundings. When assembled these grooves provide housing channels 45 and a peripheral line 47 of housing openings 39 along the dividing line 40. This peripheral line 47 extends along the complete periphery 30 of the housing 2. During assembly the first and second abutment faces 41, 42 are brought to mutual abutment and secured to each other by f. ex. gluing or welding. However, other ways to attach the first and second housing parts 3, 4 to each other may be used. Three microphone transducers 8, 18, 28 are arranged in respective recesses 12, 22, 32 in the abutment face 42 of the second housing part 4. Thus, the first microphone transducer 8 is arranged in the first recess 12, the second microphone transducer 18 in the second recess 22 and the third microphone transducer 28 is arranged in the third recess 32. A microphone opening 9, 19, 29 of each microphone transducer 8, 18, 28 faces space 7, and the microphone transducers 8, 18, 28 are all arranged on a centre line 36. There can be several reasons for using more than one microphone, e.g. in order to obtain directionality or reduce background noise. It is out of the scope of this specification to go into more details of this, as the invention also works with only one microphone transducer. The housing openings 39 are preferably small so the turbulence inducement caused by them will be minimized.

As the peripheral line 47 of housing openings 39 extends along the complete periphery 30, the wind will not "meet a wall" which causes pressure changes close to microphone transducers 8, 18, 28. Thus, the wind will pass the microphone transducers 8, 18, 28 at a relatively slow speed without inducing wind noise. This is the case, no matter which direction the wind has through the space 7. During use, the plane 6 of the peripheral line 47 is essentially parallel to the side of the user's head. This is advantageous with regard to the most frequent occurring wind directions around the headset 1. Wind direction parallel to the plane 6 of the peripheral line 47 induces very little wind noise at peripheral line 47, as the wind can enter the housing openings 39 with no change of direction. Wind coming perpendicular to the peripheral line 47 of housing openings 39 will already be slowed down by the head although the head is situated behind the headset when seen in the wind direction.

The oval rounded shape of the headset housing 2 is also advantageous, as it minimizes turbulence-induced noise.

The housing 2 is approximately 63 millimeters long, 19 millimeters wide and 19 millimeters high. The microphone transducers 8, 18, 28 are approximately 3 millimeters in diameter, and the distance between the centres of the microphone transducers 8, 18, 28 is approximately 16 millimeters. The shortest distance between one of the microphone transducers 8, 28 and the outer side of the housing in the intersecting plane 6 is approximately 6 millimeters. The thickness of the housing wall 50 is approximately 1-2 milimeter, but could be 3 mm or more.

The grooves 45 and the housing openings 39 are not shown in the right scale for clarity reasons. The grooves 45 are relatively small and has a diameter of approximately 0.5 mm and a mutual distance of approximately 0.25 mm measured at the inner side 43 of the housing wall 50.

Figure 7:
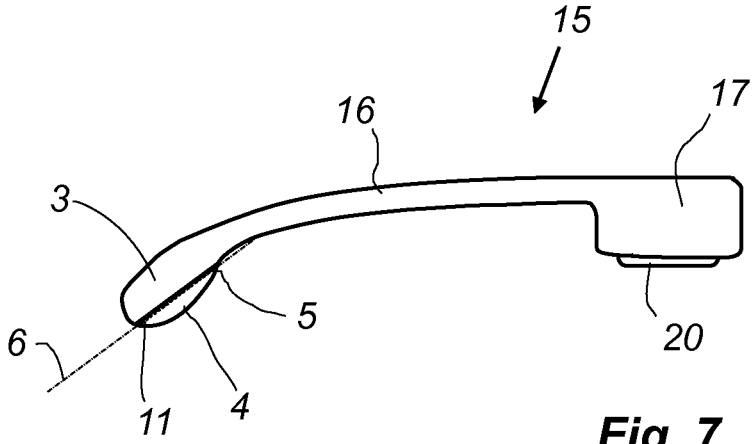
FIG. 7 is a side view of a headset according to a second embodiment of the invention.
Figure 8:
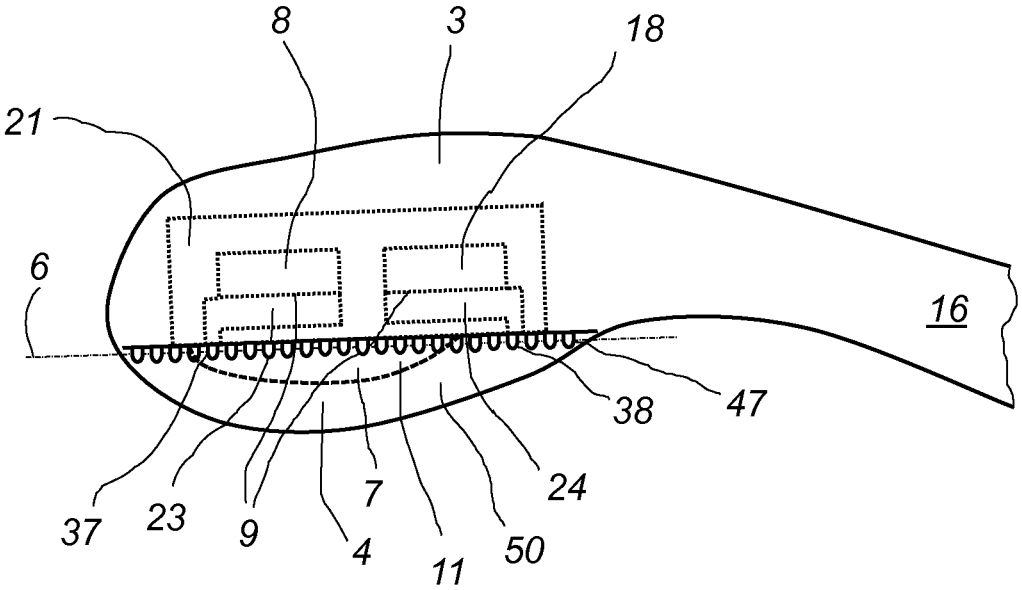
FIG. 8 is an enlarged side view of a part of the second embodiment.

FIGS. 7 and 8 disclose a second embodiment of the invention. In this case, the headset 15 is embodied as an earphone part 17 with a protruding microphone arm 16. When in use, the earphone part 17 is arranged at the user's ear with a speaker front 20 facing the ear and the microphone arm 16 pointing in the direction of the user's mouth. As shown, the microphone arm 16 has a thickened outer end part comprising two microphone transducers 8, 18. These are arranged in a so-called "microphone boot" 21, which is a rubber part encapsulating the microphone transducer 8, 28. Two sound channels 23, 24 connect the microphone openings 9 with the space 7 bounded by the housing wall 50. The sound openings 37, 38 of the sound channels 23, 24 are spaced further distance from each other than the microphone openings 9. In this way, a good sound directionality due to a relatively long distance between the sound channel openings 37, 38 is obtained, although the microphone transducers 8, 18 are placed relatively close to each other in order to obtain a compact construction. When in use, the peripheral line 47 of housing openings 39 part is essentially parallel with the user's cheek.

The first housing part 3 is approximately 20 millimeters long, 8 millimeters wide and 2 millimeter thick. The microphone transducers 8, 18 are approximately 3 millimeters in diameter. The distance between the centres of the sound channel openings is approximately 12 millimeters. The shortest distance between one of the sound channel openings 36, 37 and the outer side of the housing in the intersecting plane 6 is approximately 2 millimeters.

Figure 9:
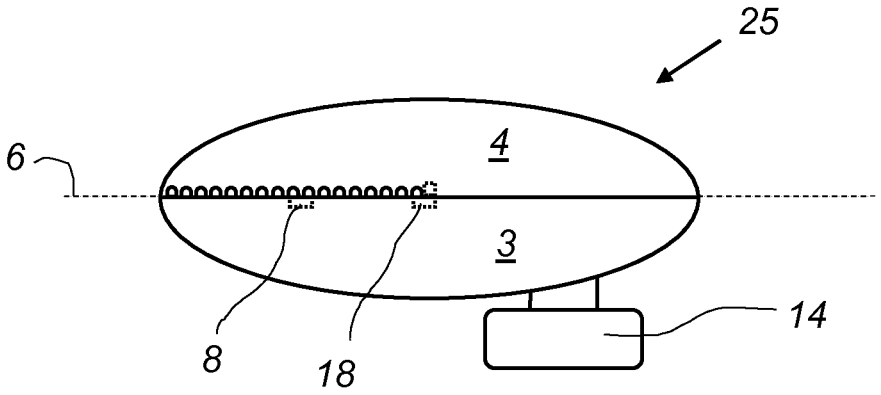
FIG. 9 is a side view of a headset according to a third embodiment of the invention.
Figure 10:
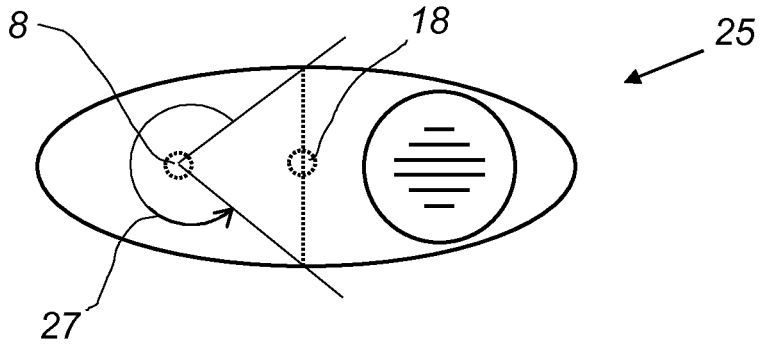
FIGS. 10 and 11 are bottom views of the third embodiment.
Figure 11:
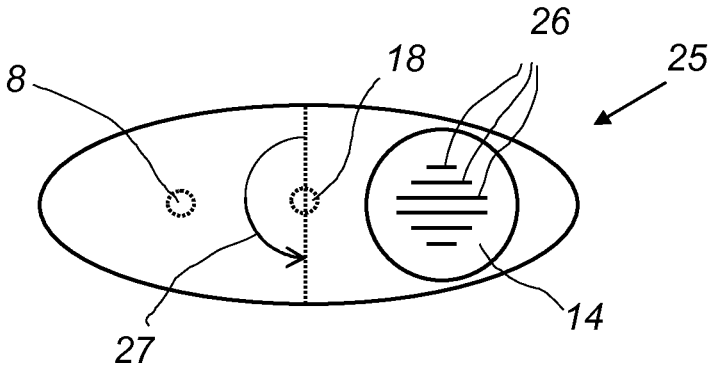

FIGS. 9, 10 and 11 disclose a third embodiment of a headset 25 according to the invention. This headset 25 has a housing 2 with the same shape as that of the first embodiment, but differs by the peripheral line 47 of housing openings 39 extending along half of the headset's 25 circumference only and having two microphone transducers 8, 18. The arrow 27 in FIGS. 7 and 8 indicate the directions the wind can flow pass the microphone transducers 8, 18 without encountering essential "blind hole" effect, which causes building up pressure, which again causes undesirable noise. Thus, in FIG. 10 it is disclosed that the wind can flow in any direction within an angle 27 of approximately 270 degrees without causing noise at the first microphone transducer 8. In FIG. 11, it is disclosed that the wind can flow in any direction within an angle 27 of approximately 180 degrees without causing noise at the second microphone transducer 18. Modern headsets with two microphones normally comprise some kind of intelligent electronics controlling the mixed output from the two microphones. Thus, if there were a strong wind in a direction outside the 180 degrees angle 27 shown in FIG. 8 but within the 270 degrees angle of FIG. 7, the electronics would attenuate the signal from the second microphone 18, as this would capture wind-induced noise. If only one microphone transducer were used in the embodiment shown in FIGS. 9-11, the first microphone transducer 8 would normally be preferred.

Figure 12:
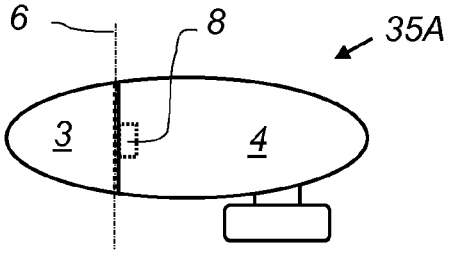
FIG. 12 is a side view of a headset according to a fourth embodiment of the invention.
Figure 13:
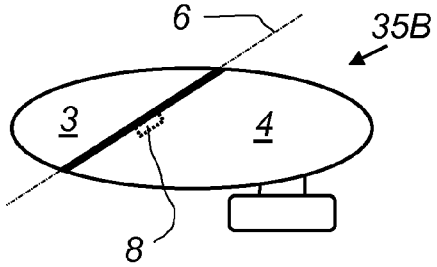
FIG. 13 is a side view of a headset according to a fifth embodiment of the invention.
Figure 14:
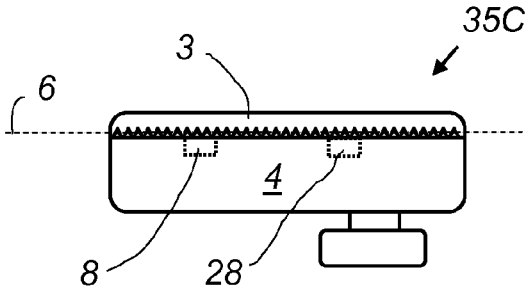
FIG. 14 is a side view of a headset according to a sixth embodiment of the invention.
Figure 15:
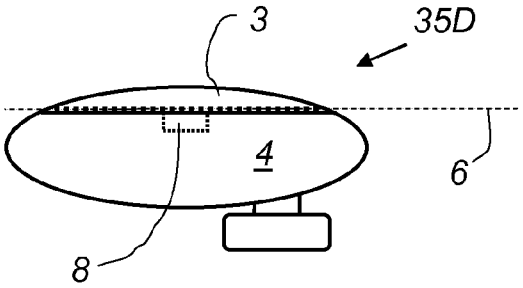
FIG. 15 is a side view of a headset according to a seventh embodiment of the invention.
Figure 16:
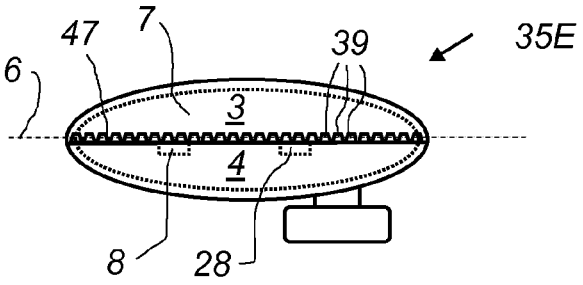
FIG. 16 is a side view of a headset according to an eighth embodiment of the invention.

FIGS. 12-22 show alternative embodiments of a headset 35 according to the invention. In FIG. 12, the intersecting plane 6 is perpendicular the longitudinal direction of the headset housing. In FIG. 13, the intersecting plane 6 is oblique in relation to the longitudinal direction of the headset housing. In FIG. 14, the intersecting plane 6 is parallel to the longitudinal direction of the headset housing and positioned relatively close to a plane outer side of a relatively thin, massive first housing part 3. Furthermore, the cross-section of the grooves 45 and the housing openings 39 are triangular. In FIG. 15, the intersecting plane 6 is parallel to the longitudinal direction of the headset housing and positioned relatively close to a rounded outer side of a massive first housing part 3. The headset 35E disclosed in FIG. 16 differs from the other embodiments by having a relatively large space 7 communicating with a peripheral line 47 of trapezoidal housing openings 39. Thus, the space 7 corresponds to the inner of the housing 2 and is filled with soft foam in the areas, which are not taken up by the headset electronics.

Figure 17:
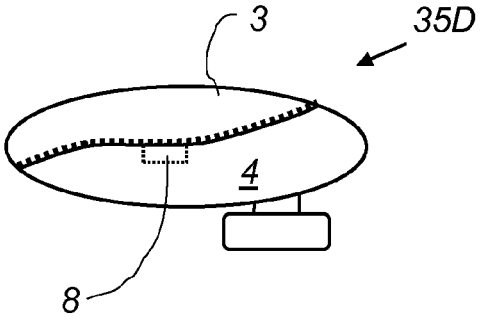
FIG. 17 is a side view of a headset according to a ninth embodiment of the invention.

FIG. 17 discloses a ninth embodiment where the peripheral line 47 of housing openings 39 do not extend in a plane but is curved. This embodiment provides a more sturdy housing may be obtained as the abutting surfaces partially lock each other in the longitudinal direction.

Figure 18:
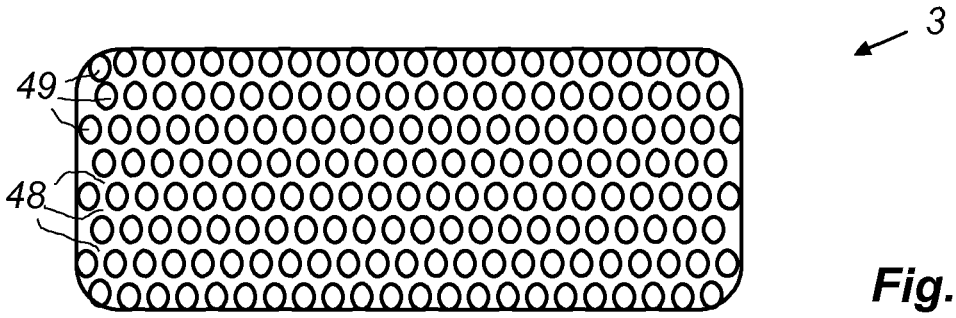
FIG. 18 is a bottom view of the first housing part according to a tenth embodiment of the invention.
Figure 19:
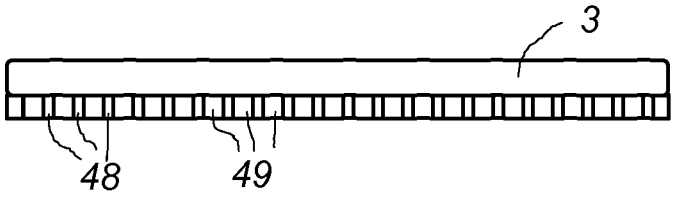
FIG. 19 is a side view of the first housing part according to the tenth embodiment of the invention.

FIGS. 18 and 19 disclose a bottom view and a side view of the first housing part 3 according to a tenth embodiment, wherein the housing channels are provided by cavities 48 between a large number of posts 49.

Figure 20:
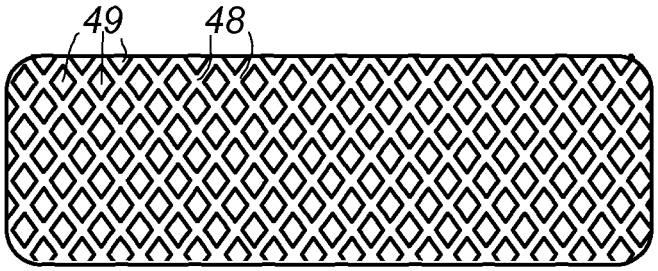
FIG. 20 is a bottom view of the first housing part according to an eleventh embodiment of the invention.
Figure 21:
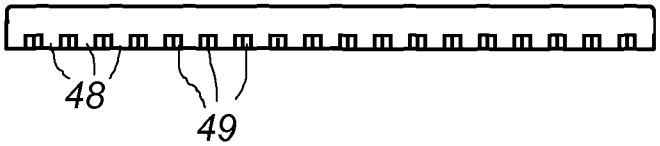
FIG. 21 is a side view of the first housing part according to the eleventh embodiment of the invention.

FIGS. 20 and 21 disclose a bottom view and a side view of the first housing part 3 according to a eleventh embodiment where the housing channels are provided by cavities 48 between a regular pattern of diamond shaped posts 49.

Figure 22:
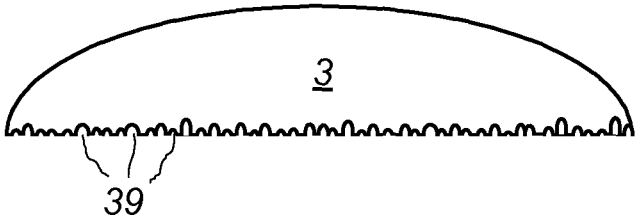
FIG. 22 is a side view of the first housing part according to a twelfth embodiment of the invention.

FIG. 22 discloses a side view of a first housing part 3 according to a twelfth embodiment of the invention, wherein the housing openings 39 have different diameters and have different mutually distances. This embodiment has the advantage that the risk of the occurrence of uniform turbulence along the line 47 of housing openings 39 is reduced.

It is not shown here but the housing channels 46 may provided as recessions 45, 48 in both the first abutment face 41 and the second abutment face 42.

A great advantage of the invention is that separate wind shielding in the form of foam, fabric, textile or the like can be avoided.

The invention is disclosed by means of different embodiments. Features from these can be combined or amended in different ways.

In most cases, a rounded housing 2 as shown in FIGS. 1-6, 9-13, 15-17 and 22 is advantageous, as this reduces the risk of turbulence at the peripheral line 47 of housing openings 39.

In the embodiments shown in FIGS. 1-6 and 12, 13, 16-17 and 22 both the first and second housing parts 3, 4 may enclose headset electronics, whereas there is no or only little room for this in the first housing part 3 of the embodiments shown in FIGS. 7-8, 15 and 18-21. However, it may not be necessary to make use of the first housing part 3 in e.g. the embodiments shown in FIGS. 7-8, 14-15 and 18-21, if the second housing part 4 is big enough for housing all the necessary electronics.

The first and second housing parts 3, 4 are preferably made of plastic. The recessions providing the housing openings and the housing channels may be moulded whereby no extra processing step is needed to provide these.

The housing may comprise more housing parts than the first and second housing parts. Thus, the first housing part may be provided as a kind of insert part between the second housing part and a third housing part.

| Reference signs: | |
|---|---|
| 1 | headset |
| 2 | housing |
| 3 | first housing part |
| 4 | second housing part |
| 6 | plane |
| 7 | space |
| 8 | microphone transducer |
| 9 | microphone opening |
| 10 | outer housing surface |
| 12 | microphone recess |
| 13 | speaker tower |
| 14 | earbud |
| 15 | headset |
| 16 | microphone arm |
| 17 | earphone part |
| 18 | microphone transducer |
| 19 | mircophone opening |
| 20 | speaker front |
| 21 | microphone boot |
| 22 | microphone recess |
| 23 | sound channel |
| 24 | sound channel |
| 25 | headset |
| 26 | openings in earbud |
| 27 | "viewing angle" of microphone transducer |
| 28 | microphone transducer |
| 29 | mircophone opening |
| 30 | periphery |
| 31 | user |
| 32 | microphone recess |
| 33 | outer ear of user |

-continued

| Reference signs: | |
|---|---|
| 34 | front face of ear bud |
| 35 | headset |
| 36 | centre line |
| 37 | opening of first sound channel |
| 38 | opening of second sound channel |
| 39 | housing openings |
| 40 | divding line |
| 41 | first abutment face |
| 42 | second abutment face |
| 43 | inner side of housing wall |
| 44 | outer side of housing wall |
| 45 | groove |
| 46 | housing channel |
| 47 | peripheral line of housing openings |
| 48 | cavity |
| 49 | post |
| 50 | housing wall |

The invention claimed is:

1. A communication device comprising a housing, the housing comprises a housing wall with an inner side and an outer side, and wherein the housing comprises a first housing part and a second housing part, which are joined along a dividing line, whereby a first abutment face of the first housing part abuts a second abutment face of the second housing part along the dividing line, a space bounded by the inner side of the housing wall, a first microphone transducer arranged in the housing, the first microphone transducer comprises a microphone opening, which is connected to the space, wherein the space is communicating with an area surroundings the communications device via a peripheral line of housing openings in the outer side of the housing wall arranged along the dividing line, and housing channels extending between the housing openings and the inner side of the housing wall, and wherein the housing channels and the housing openings are provided as recessions in the first abutment face.

2. A communication device according to claim 1, wherein the diameter of the housing openings are less than 3 mm, 2 mm, 1 mm, 0.5 mm, 0.25mm or 0.1 mm.

3. A communication device according to claim 2, wherein the distance between the housing openings is less than 3 mm, 2 mm, 1 mm, 0.5 mm or 0.25 mm.

4. A communication device according to claim 1, wherein the housing channels are provided as narrow grooves.

5. A communication device according to claim 1, wherein the housing channels are provided by cavities between posts bordering the cavities.

6. A communication device according to claim 1, wherein the housing channels are provided as recessions in both the first abutment face and the second abutment face.

7. A communication device according to claim 1, wherein the housing openings of the same communication device have different diameters and/or have different mutually distances.

8. A communication device according to claim 1, wherein peripheral line of housing openings extends along at least 180, preferably at least 270, more preferably at least 315 and most preferably 360 degrees of the periphery, when seen from a microphone transducer.

9. A communication device according to claim 1, wherein the housing comprises a boom, and wherein the peripheral line of housing openings is provided at the end of the boom.

10. A communication device of claim 1, wherein the housing is arranged at the ear of a user and comprising a speaker.

11. A communication device according to claim 10, wherein the communication device includes a headset housing that includes transceiver electronics for wireless communication with a further communications device.

12. A communication device according to claim 1, wherein whereby the first abutment face and the second abutment face are non-planar.

13. A communication device, according to claim 1, wherein the dividing line extends along the outermost periphery, when seen in projection.

14. Method of manufacturing a communication device comprising the following steps:

providing a first housing part with a housing wall with an inner side, an outer side and a first abutment face, providing housing openings along a peripheral line in the outer side of the housing wall and housing channels as recessions in the first abutment face, providing a second housing part with a housing wall with an inner side, an outer side and a second abutment face, joining the first housing part and the second housing part to a housing, such that the first abutment face abuts the first abutment face along a dividing line, whereby the inner side of the housing bounds a space, and whereby the recessions provide housing channels extending between the housing openings and the inner side of the housing wall, so that the space can communicate with an area surroundings the communications device, and providing a first microphone transducer in the housing, wherein the first microphone transducer comprises a microphone opening, which is connected to the space.

15. A method according to claim 14, wherein the recessions in the first abutment face providing the housing openings and the housing channels are provided by moulding, including injection moulding.

* * * * *